US010704253B1

(12) United States Patent
Houston et al.

(10) Patent No.: US 10,704,253 B1
(45) Date of Patent: Jul. 7, 2020

(54) FLOOR PLATE FOR A MULTI-STORY BUILDING

(71) Applicant: BIG TIME INVESTMENT, LLC, Southfield, MI (US)

(72) Inventors: Stephen T. Houston, Lake Orion, MI (US); Brian K. Threet, Plymouth, MI (US)

(73) Assignee: BIG TIME INVESTMENT, LLC, Southfield, MI (US)

( * ) Notice: Subject to any disclaimer, the term of this patent is extended or adjusted under 35 U.S.C. 154(b) by 0 days.

(21) Appl. No.: 16/448,531

(22) Filed: Jun. 21, 2019

(51) Int. Cl.
*E04B 1/35* (2006.01)

(52) U.S. Cl.
CPC ..... *E04B 1/3511* (2013.01); *E04B 1/3516* (2013.01); *E04B 2103/02* (2013.01)

(58) Field of Classification Search
CPC .. E04B 1/3511; E04B 1/3516; E04B 2103/06; E04B 1/24; E04B 1/30; E04B 1/34
USPC ..... 52/125.1, 236.6
See application file for complete search history.

(56) References Cited

U.S. PATENT DOCUMENTS 2,675,895 A * 4/1954 Loewenstein ..... E04B 1/24 52/236.3
3,283,465 A * 11/1966 Cheskin ..... E04B 1/24 52/653.1
3,302,363 A * 2/1967 Frey ..... E04B 1/3511 52/745.04
3,927,499 A * 12/1975 Papayoti ..... E04B 1/19 52/263
3,981,109 A * 9/1976 Termohlen ..... E04B 1/3404 52/125.1
4,071,988 A * 2/1978 Bowes ..... E04B 1/3511 52/127.1
2005/0115164 A1* 6/2005 Han ..... E04B 1/24 52/79.1
2008/0276550 A1* 11/2008 Termohlen ..... E02D 27/12 52/169.9
2017/0089062 A1* 3/2017 Thornton ..... E04B 1/4114
2018/0371742 A1* 12/2018 Saenz Saenz ..... E04B 1/02

* cited by examiner

*Primary Examiner* — Brian D Mattei
(74) *Attorney, Agent, or Firm* — Quinn IP Law

(57) ABSTRACT

A multi-story building includes a vertical support core that is disposed on a foundation, and a plurality of liftable floor plates. The liftable floor plates are fabricated at ground level and lifted into place on the vertical support core. The vertical support core includes vertically-oriented shear walls, and vertically-oriented columns disposed at corners thereof. Vertically-oriented first slots are formed between adjacent ones of the columns disposed at the corners. Each of the liftable floor plates includes girders, lateral framing members, diagonal framing members, and spandrels disposed at an outer periphery of the floor plate. The diagonal framing members are disposed diagonally in relation the lateral framing members and the first and second girders of the floor plate. The diagonal framing members extend through the first slots in the vertical support core and extend to one of the spandrels disposed at the outer periphery of the floor plate.

20 Claims, 3 Drawing Sheets

FLOOR PLATE FOR A MULTI-STORY BUILDING

TECHNICAL FIELD

The disclosure generally relates to a floor plate for a multi-story building, and fabrication system therefor.

BACKGROUND

Many methods of fabricating multi-story buildings exist. Traditionally, multi-story buildings have been fabricated upward from the ground, wherein fabrication begins on a ground level by attaching higher elevation structural elements on top of previously assembled lower structural elements to fabricate the building in upward direction, i.e., from bottom up. This method requires that the structural elements be lifted by a crane and connected in situ at elevation. This is particularly timely and costly when fabricating tall buildings.

One fabrication method includes fabricating a vertical support core of the building, which is designed to carry all structural loads of the building. The floor plates, including the roof structure surrounding a vertical support core, are fabricated around the base of the vertical support core at ground level, lifted vertically into place with strand jacks located on top of the vertical support core, and then connected to the vertical support core. In this matter, the roof structure surrounding the vertical support core is assembled at ground level, lifted to its final elevation, and then attached to the vertical support core. After the roof structure is attached to the vertical support core, the top floor plate is assembled at ground level, lifted to its final elevation, and then attached to the vertical support core. Subsequent floor plates are assembled and attached to the vertical support core in the same manner in a descending order. By so doing, the roof and the floor plates of the building are fabricated from top down.

The roof and floor plates may include cantilevered portions that extend from the vertical support core. Design features to minimize deflection of the roof and floor plates at the outer periphery of each floor plate may include increasing depth of framing members of the floor plates, which can affect floor height, building height, and material cost.

SUMMARY

A multi-story building is described, and includes a vertical support core that is disposed on a foundation, and a plurality of liftable floor plates that are slidably disposed on the vertical support core. The liftable floor plates are fabricated at ground level and lifted into place on the vertical support core. The vertical support core includes a plurality of vertically-oriented shear walls arranged in a rectilinear shape, and a plurality of vertically-oriented columns disposed at corners thereof. A plurality of vertically-oriented first slots are formed between adjacent ones of the columns disposed at the corners. Each of the liftable floor plates includes a plurality of girders, a plurality of lateral framing members, a plurality of diagonal framing members, and a plurality of spandrels disposed at an outer periphery of the floor plate. The lateral framing members are disposed transverse to the first and second girders of the floor plate. The diagonal framing members are disposed diagonally in relation to the lateral framing members and the first and second girders of the floor plate. The diagonal framing members extend through the first slots in the vertical support core and extend to one of the spandrels disposed at the outer periphery of the floor plate.

An aspect of the disclosure includes a distal end of one of the diagonal framing members being connected to a first and a second of the spandrels.

Another aspect of the disclosure includes the distal end of one of the diagonal framing members and the first and second of the spandrels forming a corner of the floor plate.

Another aspect of the disclosure includes a proximal end of one of the diagonal framing members being connected to one of the lateral framing members.

Another aspect of the disclosure includes a plurality of vertically-oriented second slots, wherein each of the second slots is formed between one of the vertically-oriented shear walls and the vertically-oriented columns disposed at the corners.

Another aspect of the disclosure includes the girders being disposed in the second slots and disposed adjacent to the vertically-oriented shear walls that are disposed on the sides of the vertical support core.

Another aspect of the disclosure includes the vertically-oriented columns being L-shaped columns.

Another aspect of the disclosure includes the vertically-oriented columns and the vertically-oriented shear walls being composed of hardenable material.

Another aspect of the disclosure includes a plurality of jacking elements being disposed at a top portion of the vertically-oriented columns, and the jacking elements are coupled to the liftable floor plates.

Another aspect of the disclosure includes the jacking elements comprise strand jacks.

Another aspect of the disclosure includes each of the liftable floor plates having a rectilinear configuration.

Another aspect of the disclosure includes the vertically-oriented shear walls of the vertical support core including opposed sidewalls and opposed inner endwalls, wherein the opposed sidewalls and opposed inner endwalls are arranged to form a vertically-oriented elevator shaft.

Another aspect of the disclosure includes each of the floor plates being slidably disposed on the vertical support core.

Another aspect of the disclosure includes each of the floor plates corresponding to one of the stories of the building.

Another aspect of the disclosure includes a topmost one of the floor plates being a roof for the multi-story building.

Another aspect of the disclosure includes each of the floor plates being cantilevered from the vertical support core.

The above features and advantages and other features and advantages of the present teachings are readily apparent from the following detailed description of the best modes for carrying out the teachings when taken in connection with the accompanying drawings.

The appended drawings are not necessarily to scale, and present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid unnecessarily obscuring the disclosure. Furthermore, the disclosure, as illustrated and described herein, may be practiced in the absence of an element that is not specifically disclosed herein.

Those having ordinary skill in the art will recognize that terms such as "above," "below," "upward," "downward," "top," "bottom," etc., are used descriptively for the figures, and do not represent limitations on the scope of the disclosure, as defined by the appended claims.

Figure 1:
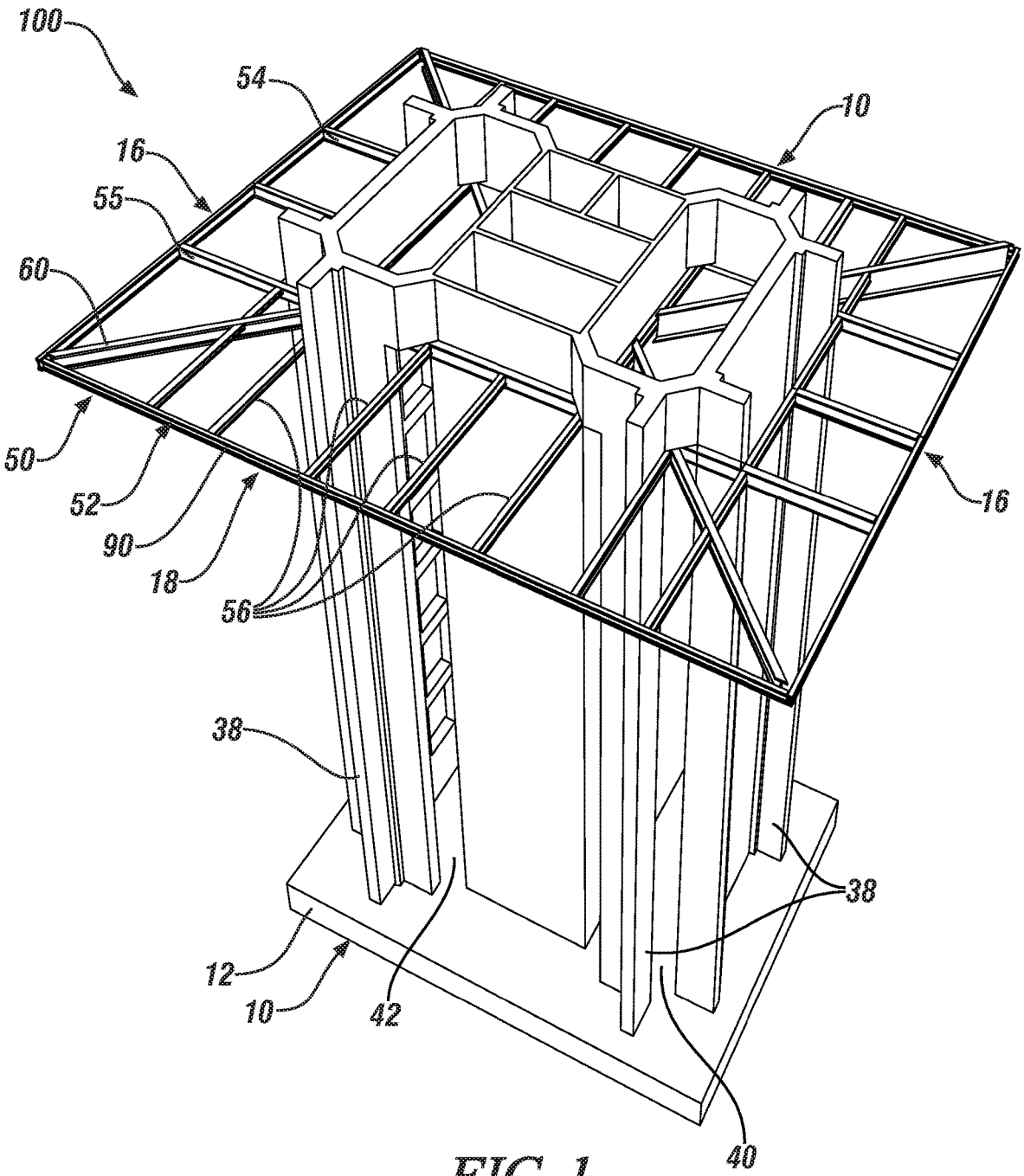
FIG. 1 is a schematic three-dimensional isometric view of a partially fabricated building showing a vertical support core of the building and a single floor plate, in accordance with the disclosure.
Figure 2:
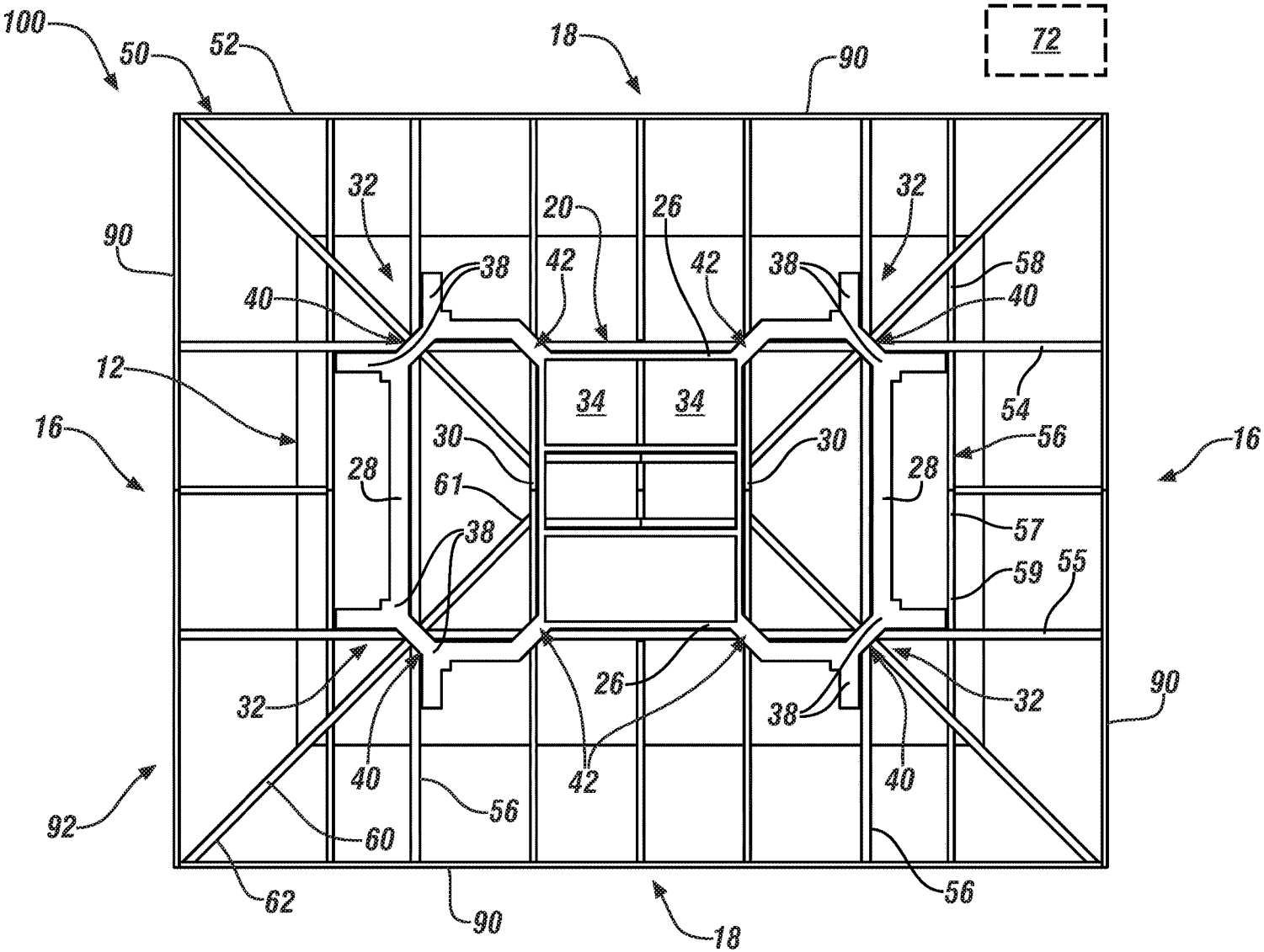
FIG. 2 is a schematic two-dimensional top plan view of a partially fabricated building showing a vertical support core and a single floor plate of the building, in accordance with the disclosure.
Figure 3:
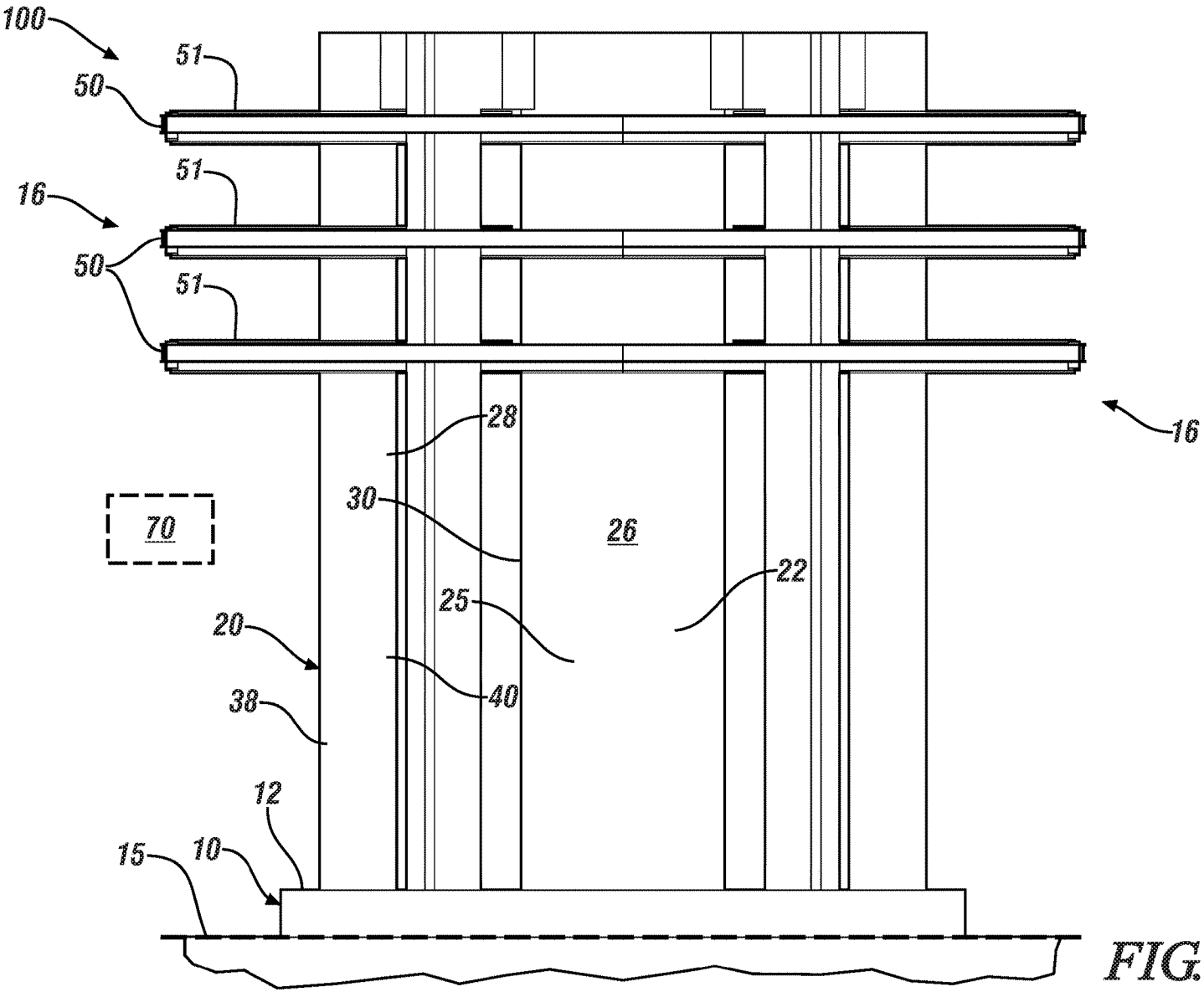
FIG. 3 is a schematic two-dimensional side-view of a partially fabricated building showing a vertical support core of the building and a plurality of floor plates, in accordance with the disclosure.

Referring to the Figures, wherein like numerals indicate like parts throughout the several views, FIGS. 1, 2, and 3 show schematic views of a partially fabricated building 100 that includes one or a plurality of floor plates 50 that are disposed on a vertical support core 20, wherein the vertical support core 20 is disposed on a base 12 of a foundation 10. The multi-story building 100 is advantageously fabricated employing a top-down fabrication process, in which each of the floor plates 50 is fabricated at ground elevation 15, lifted to a respective final elevation, and attached to the vertical support core 20 in a descending, sequential order. The multi-story building 100 is described with reference to a vertical plane 70 and a horizontal plane 72.

As used herein, the term "floor plate 50" may include a floor plate assembly 52 and all other structural or frame members, e.g., joists and/or purlins, flooring, e.g., concrete floor, interior walls, exterior curtain walls, modular room subassemblies, e.g., a lavatory module, utilities, etc., that form a floor or level of the building 100. The floor plate 50 may include a plate for a roof structure of the building 100, as well as a plate for a floor or level of the building 100. As used herein and shown in the Figures, the reference numeral 50 may refer to and indicate any floor plate 50 of the building 100.

The floor plate 50 and the vertical support core 20 are described in context of opposed ends 16 and opposed sides 18. The vertical support core 20 includes opposed sidewalls 26 and opposed inner endwalls 28, outer endwalls 30, and a plurality of L-shaped columns 38 that are disposed on corners 32 thereof. The opposed sidewalls 26 and opposed inner endwalls 28 form a rectilinear center section 25.

The outer endwalls 30 are formed between and connect the L-shaped columns 38 that are disposed on the ends 16. Adjacent pairs of the L-shaped columns 38 disposed on the corners 32 of the vertical support core 20 form first, vertically-oriented corner slots 40. Adjacent pairs of the L-shaped columns 38 that are disposed on each of the sides 18 of the vertical support core 20 are connected to the sidewalls 26 only at a top portion of the L-shaped columns 38, and form second, vertically-oriented side slots 42 therebelow.

The vertical support core 20 includes a vertical slip form system 22. The vertical slip form system 22 is operable to form the vertical support core 20 of the building 100 from a hardenable material 24, while moving vertically upward from the ground elevation 15 to a finished elevation. The hardenable material 24 may include, but is not limited to, a concrete mixture or other similar composition. The hardenable material 24 may include one or more additives to enhance one or more physical characteristics of the hardenable mixture, such as to reduce curing time, reduce slump, increase strength, etc. The specific type and contents of the hardenable mixture may be dependent upon the specific application of the building 100, and may be dependent upon the specific geographic region in which the building 100 is being fabricated. The specific type and contents of the hardenable material 24 are understood by those skilled in the art, are not pertinent to the teachings of this disclosure, and are therefore not described in greater detail herein.

The vertical slip form system 22 includes a plurality of form panels (not shown) for forming the opposed sidewalls 26, opposed inner endwalls 28, outer endwalls 30, and the plurality of L-shaped columns 38. The form panels are arranged to include inner panels for forming an interior surface of the respective sidewalls 26, opposed inner endwalls 28, outer endwalls 30, and the plurality of L-shaped columns 38 of the vertical support core 20, and outer panels for forming an exterior surface of the respective sidewalls 26, opposed inner endwalls 28, outer endwalls 30, and the plurality of L-shaped columns 38 of the vertical support core 20. The inner panels and the outer panels are spaced apart from each other to define a thickness of the wall therebetween. The vertical support core 20 is designed to carry the vertical loads the building 100. As such, the shape of the vertical support core 20 may be designed as necessary to provide the required compressive strength, shear strength, and bending strength for the particular application, size, and location of the building 100.

The sidewalls 26, opposed inner endwalls 28, outer endwalls 30, and the plurality of L-shaped columns 38 of the vertical support core 20 may be configured to include multiple load bearing columns connected by shear walls. In other embodiments, the sidewalls 26, opposed inner endwalls 28, outer endwalls 30, and the plurality of L-shaped columns 38 of the vertical support core 20 may be designed to include a generally uniform fabrication around the entire perimeter of the vertical support core 20. Regardless of the respective cross-sectional shapes, the form panels are positioned to define the cross sectional shape of the vertical support core 20, relative to the horizontal plane. The cross sectional shapes of the sidewalls 26 and opposed inner endwalls 28 of the vertical support core 20 remain consistent throughout the height of the building 100. In addition, the sidewalls 26 and opposed inner endwalls 28 may be arranged to form internal structures that serve as vertically-oriented elevator shafts 34, and/or other vertically-oriented apertures that may be employed for installation of fixtures for ventilation and utilities.

As shown in FIG. 1, the fabrication system may further include at least one lifting device (not shown), which may be used for raising the floor plates 50 relative to the vertical support core 20. For example, the lifting devices may include, but are not limited to, a plurality of strand jacks.

However, the lifting devices may include other devices capable of lifting the floor plates 50 of the building 100. The strand jacks grasp and move a cable to lift heavy objects. The specific features and operation of the strand jacks are known to those skilled in the art, are not pertinent to the teachings of this disclosure, and are therefore not described herein.

The foundation 10 includes the base 12, which may be in the form of a mat foundation, and may optionally include pilings supporting the base. The specific design and fabrication of the foundation 10 is dependent upon the soil conditions and the loading requirements of the building 100. The foundation 10 supports the vertical support core 20, and transfers the loading from the vertical support core 20 to the ground. The specific fabrication of the foundation 10 will vary for each building 100 and site requirements, is not pertinent to the teachings of this disclosure, and is therefore not described in detail herein.

The floor plates 50 make up discrete sections of the building 100. Each of the floor plates 50 is assembled a few feet above ground level and lifted to its design elevation employing one or more of the lifting devices and/or another vertical conveyance structure(s), and permanently affixed to and supported by the vertical support core 20. The floor plates 50 are cantilevered from the lifting devices and therefore, the weight of each of the floor plates 50 is best distributed symmetrically around the vertical support core 20 and the lifting devices. The floor plates 50 may be designed asymmetrically around the lifting devices so long as proper design and loading techniques are utilized.

As described herein with reference to FIGS. 1, 2, and 3, each of the floor plates 50 is assembled as a woven structure in the form of main framing members e.g., first and second girders 54, 55, a plurality of lateral framing members 56, diagonal framing members 60, and spandrels 90. The girders 54, 55 run continuously between supports that may be attached to the lifting devices. The lateral framing members 56 penetrate apertures in the first and second girders 54, 55 and are supported at multiple points with preset cambers.

Camber is defined as a deviation from a flat, level, horizontal plane. Each of the lateral framing members 56 is an assembled part that includes a medial beam 57 and first and second cantilevered beams 58, 59. This arrangement results in a floor assembly that is strong, and thus can be exploited to reduce beam depth without increasing vertical deflection at the cantilevered portion. The woven structure-framed roof and floor plates impart precise amounts of camber at the connection points. The connections may be friction-bolted at inflection points to meet desired cambers. The combination of bolted, four-sided connectors together with the woven structure creates an efficient and flexible roof and floor plate structure that may be adjusted for camber control during assembly. The woven structure maximizes the strength of the lateral framing members 56, permitting beam depth to be minimized. Weight and overall depth of the floor plates 50 is thereby minimized. Furthermore, openings in the girders 54, 55 that permit the lateral framing members 56 and diagonal framing members 60 to penetrate are cut to close tolerances, providing inherent bracing at locations of penetrations. This bracing further acts to prevent unintended rotation of the lateral framing members 56 and diagonal framing members 60 during assembly even before any connections have been installed, providing a safety benefit.

The floor plate 50 includes first and second girders 54, 55 that are arranged in parallel and slidably disposed on opposed sides of the vertical support core 20 in a manner that permits and facilitates vertical conveyance. The first and second girders 54, 55 are disposed on opposed sides 18 of the vertical support core 20 such that they pass through the respective corner slots 40 and side slots 42.

Each of the first and second girders 54, 55 includes a vertically-oriented web portion and a top and bottom flange portions. The first and second girders 54, 55 may each be configured, by way of non-limiting examples as an I-beam, a C-beam, a T-beam, an L-beam, a square beam, a rectangular beam, etc. A plurality of apertures are formed in the vertically-oriented web portions of each of the first and second girders 54, 55, and are configured to accommodate insertion of one of the first and second cantilevered beams 58, 59 of the lateral framing members 56 and also accommodate insertion of the diagonal framing members 60.

A plurality of the lateral framing members 56 are disposed transverse to the first and second girders 54, 55. Each of the lateral framing members 56 includes the medial beam 57 that is attached to the first and second cantilevered beams 58, 59, and is arranged transverse to and supported by the first and second girders 54, 55.

The medial beam 57 and the first and second cantilevered beams 58, 59 are each configured to have a flat beam section on a top portion of the respective beam along its longitudinal axis. The medial beam 57 may be configured as an I-beam, a C-beam, a T-beam, an L-beam, a square beam, a rectangular beam, etc., which defines a respective cross-sectional shape. The first and second cantilevered beams 58, 59 may be configured as an I-beam, a C-beam, a T-beam, an L-beam, a square beam, a rectangular beam, etc., which defines a respective cross-sectional shape. The cross-sectional shape associated with the first cantilevered beam 58 corresponds to the respective aperture in the first girder 54, and the cross-sectional shape associated with the second cantilevered beam 59 corresponds to the respective aperture in the second girder 55. Each of the first cantilevered beams 58 includes first and second ends with a plurality of bolt through-holes disposed thereat. Each of the second cantilevered beams 59 includes first and second ends with a plurality of bolt through-holes disposed thereat. The medial beams 57 are horizontally disposed between the first and second girders 54, 55. The length of each medial beam 57 is selected to define inflection points.

The first end of each of the first cantilevered beams 58 is threaded through one of the apertures of the first girder 54 and is attached to the first end of the medial beam 57 at a first junction, which defines a first inflection point that has a first camber. The first end of the first cantilevered beam 58 is attached to the first end of the medial beam 57 employing span plates and friction bolts via the bolt through-holes. The first cantilevered beam 58 is also attached to the first girder 54 mid-span employing angle plates and friction bolts via other bolt through-holes. The second ends of the first cantilevered beams 58 are attached to a spandrel 90.

In like manner, the first ends of the second cantilevered beams 59 are threaded through one of the apertures of the second girder 55 and attached to the second end of the medial beam 57 at a second junction, which defines a second inflection point that has a second camber. The first end of the second cantilevered beam 59 is attached to the second end of the respective medial beam 57 employing span plates and friction bolts via respective bolt through-holes. The second cantilevered beam 59 is also attached to the second girder 55 mid-span employing angle plates and friction bolts via other bolt through-holes. The second ends of the second cantilevered beams 59 are attached to another of the spandrels 90.

The first and second cambers are selected such that an upper planar surface 51 of the floor plate 50 forms a flat horizontal surface when the floor plate 50 is fixedly attached to the vertical support core 20. The first inflection point is defined for each of the lateral framing members 56 at the first junction between the first end of the first cantilevered beams 58 attached to a first end of the medial beam 57, with the associated first camber. Likewise, the second inflection point is defined at the second junction between a first end of the second cantilevered beam 59 attached to a second end of the medial beam, with the associated second camber.

The diagonal framing members 60 are arranged diagonally in relation to the lateral framing members 56 and the first and second girders 54, 55 of the floor plate assembly 52, and extend through the first slots 40 that are formed by the L-shaped columns 38, and extend to one of the spandrels 90 disposed at the outer periphery 92 of the floor plate 50. A distal end of one of the diagonal framing members 60 is connected to two of the spandrels 90, wherein one of the spandrels 90 is arranged on the side 18 and one of the spandrels 90 is arranged on the end 16, and the two spandrels 90 and the distal end of the associated diagonal framing member 60 form one of the corners of the floor plate 50.

The diagonal framing members 60 are each configured to have a flat beam section on a top portion of the respective beam along its longitudinal axis, and may be configured as an I-beam, a C-beam, a T-beam, an L-beam, a square beam, a rectangular beam, etc., which defines a respective cross-sectional shape. The cross-sectional shape associated with the diagonal framing members 60 corresponds to the respective aperture in the respective first or second girder 54, 55. Each of the diagonal framing members 60 includes a first, proximal end 61 and a second distal end 62 with a plurality of bolt through-holes disposed thereat.

The first end of each of the diagonal framing members 60 is threaded through one of the apertures of the respective first or second girder 54, 55 and is attached to one of the lateral framing members 56 that is immediately adjacent to one of the inner end walls 28 of the vertical support core 20. The first end is attached employing span plates and friction bolts via the bolt through-holes. The diagonal framing member 60 is also attached to the respective first or second girder 54, 55 mid-span employing angle plates and friction bolts via other bolt through-holes. The second ends of the diagonal framing members 60 are attached to two of the spandrels 90 to form one of the corners of the floor plate 50.

The bolt through-holes and/or the first ends of the first and second cantilevered beams may be slightly enlarged to allow play in the respective junction to permit pivoting of the respective diagonal framing member 60 at the respective inflection point, which can be employed to impart and adjust the camber. This arrangement facilitates camber control and adjustment to achieve flatness of each of the floor plates 50 during construction. This arrangement permits adjustment of the final geometry of the floor plate 50 during fabrication to achieve a desired camber prior to tightening of the friction bolts. Prior to fabrication of one of the floor plates 50, each previously constructed, lifted and permanently supported one of the floor plates 50 is analyzed for deflection as part of the design process. Anticipated deflection values for each of the completed plates in its permanently supported configuration are plotted for key points on the structural frame. The purpose is to allow each roof and floor plate to achieve a flat, level geometry in its final connected condition.

The building 100 employs cantilevered floor plates for roof and floor plate framing. The roof and floor plate assemblies have progressing conditions of loading and deflection throughout fabrication, lifting to final elevation, permanent connection to the vertical conveyance structure, application of service loads, and similar conditions encountered during construction and use. Consequently, the structural engineering process must incorporate these multiple and varying conditions into the design of the structural system, along with consideration of appropriate tolerances for other elements, including but not limited to building envelope, interior partitions, mechanical and electrical systems, and live loads.

The camber of each roof (not shown) and floor plate assembly 52 in its final connected condition is determined by conventional engineering calculation, resulting in a final deflection value from true level at key points along the structural frame. The camber required for the roof or floor plate can then be set so that it will achieve a flat, level configuration in its final connected condition. As each floor is installed in its final connected condition, field measurements of flatness are taken. Additional adjustments to camber may be made through the adjustment of the imparted camber connections to improve flatness tolerances of each successively installed floor plate.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. A multi-story building, comprising:

a vertical support core disposed on a foundation, and a plurality of liftable floor plates slidably disposed on the vertical support core;

wherein the vertical support core includes:

a plurality of vertically-oriented columns disposed at corners of the vertical support core, a plurality of vertically-oriented shear walls disposed between adjacent ones of the corners of the vertical support core, and a plurality of vertically-oriented first slots, wherein each of the first slots is formed between adjacent ones of the columns disposed at the corners of the vertical support core; and wherein each of the plurality of liftable floor plates includes first and second girders, a plurality of lateral framing members, a plurality of diagonal framing members, and a plurality of spandrels disposed at an outer periphery of the floor plate;

wherein the lateral framing members are disposed transverse to the first and second girders of the floor plate;

wherein the diagonal framing members are disposed diagonally in relation to the lateral framing members and the first and second girders of the floor plate; and wherein the diagonal framing members extend through the first slots in the vertical support core and extend to one of the spandrels disposed at the outer periphery of the floor plate.

2. The multi-story building of claim 1, wherein a distal end of one of the diagonal framing members is connected to a first and a second of the spandrels.

3. The multi-story building of claim 2, wherein the distal end of the one of the diagonal framing members and the first and second of the spandrels form a corner of the floor plate.

4. The multi-story building of claim 1, wherein a proximal end of one of the diagonal framing members is connected to one of the lateral framing members.

5. The multi-story building of claim 1, wherein each of the floor plates is slidably disposed on the vertical support core.

6. The multi-story building of claim 1, wherein each of the floor plates corresponds to one of the stories of the multi-story building.

7. The multi-story building of claim 1, wherein a topmost one of the floor plates comprises a roof for the multi-story building.

8. The multi-story building of claim 1, wherein each of the floor plates is cantilevered from the vertical support core.

9. The multi-story building of claim 1 further comprising a plurality of vertically-oriented second slots, wherein each of the second slots is formed between one of the vertically-oriented shear walls and the vertically-oriented columns disposed at the corners.

10. The multi-story building of claim 9, wherein the girders are disposed in the second slots and disposed adjacent to the vertically-oriented shear walls of the vertical support core.

11. The multi-story building of claim 9, wherein the vertically-oriented columns comprise L-shaped columns.

12. The multi-story building of claim 1, further comprising a plurality of jacking elements disposed at a top portion of the vertically-oriented columns, and wherein the jacking elements are coupled to the liftable floor plates.

13. The multi-story building of claim 12, wherein the jacking elements comprise strand jacks.

14. The multi-story building of claim 1, wherein each of the liftable floor plates has a rectilinear configuration.

15. The multi-story building of claim 1, wherein the vertically-oriented shear walls comprise opposed sidewalls and opposed inner endwalls, and wherein the opposed sidewalls and the opposed inner endwalls are arranged to form a vertically-oriented elevator shaft.

16. The multi-story building of claim 1, wherein the vertically-oriented columns and the vertically-oriented shear walls are composed of hardenable material.

17. A multi-story building, comprising:

a vertical support core disposed on a foundation, and a plurality of liftable floor plates slidably disposed on the vertical support core;

wherein the vertical support core includes:

a plurality of vertically-oriented columns disposed at corners of the vertical support core, a plurality of vertically-oriented shear walls disposed between adjacent ones of the corners of the vertical support core, wherein a plurality of first slots are formed between adjacent ones of the columns disposed at the corners of the vertical support core, and wherein a plurality of second slots are formed between one of the vertically-oriented shear walls and the vertically-oriented columns disposed at the corners; and wherein each of the plurality of liftable floor plates includes first and second girders, a plurality of lateral framing members, a plurality of diagonal framing members, and a plurality of spandrels disposed at an outer periphery of the floor plate; and wherein the diagonal framing members extend through the first slots in the vertical support core and extend to one of the spandrels disposed at the outer periphery of the floor plate.

18. The multi-story building of claim 17, wherein each of the floor plates is slidably disposed on the vertical support core.

19. The multi-story building of claim 17, wherein each of the floor plates is cantilevered from the vertical support core.

20. The multi-story building of claim 17, wherein the vertically-oriented columns comprise L-shaped columns.

* * * * *